US007556847B2

(12) United States Patent
Seneor

(10) Patent No.: US 7,556,847 B2
(45) Date of Patent: Jul. 7, 2009

(54) UNDERGROUND RESERVOIR FOR STORING LIQUID PRODUCTS AND A PROCESS FOR MANUFACTURING AN UNDERGROUND RESERVOIR

(75) Inventor: David Seneor, São Paulo (BR)

(73) Assignee: Edson Goncalves, Sao Paulo (BR)

( * ) Notice: Subject to any disclaimer, the term of this patent is extended or adjusted under 35 U.S.C. 154(b) by 0 days.

(21) Appl. No.: 11/606,851

(22) Filed: Nov. 30, 2006

(65) Prior Publication Data

US 2007/0092671 A1 Apr. 26, 2007

Related U.S. Application Data

(63) Continuation of application No. 09/763,135, filed as application No. PCT/BR00/00063 on Jun. 15, 2000, now abandoned.

(30) Foreign Application Priority Data

Jun. 17, 1999 (BR) ..... PI 9902766

(51) Int. Cl.
*B29D 22/00* (2006.01)
*B29D 23/00* (2006.01)
*B32B 1/08* (2006.01)

(52) U.S. Cl. ..... 428/35.7; 428/34.2; 427/421.1; 427/427.4; 427/426; 220/567.1; 220/567.2; 220/62.2; 220/589; 220/402; 220/414

(58) Field of Classification Search ..... 428/34.2, 428/35.7; 427/421.1, 427.4, 426; 220/567.1, 220/567.2, 62.2, 589, 402, 414
See application file for complete search history.

(56) References Cited

U.S. PATENT DOCUMENTS

| | | | |
|---|---|---|---|
| 3,616,178 | A | 10/1971 | Guaynabe et al. |
| 4,510,019 | A | 4/1985 | Bartelloni |
| 4,695,618 | A | 9/1987 | Mowrer |
| 4,871,078 | A | 10/1989 | Sharp |
| 5,090,586 | A | 2/1992 | Mitchell |
| 5,130,205 | A | 7/1992 | Vu et al. |
| 5,167,352 | A | 12/1992 | Robbins |
| 5,328,733 | A | 7/1994 | Oxley |
| 5,494,183 | A | 2/1996 | Sharp |
| 5,553,734 | A | 9/1996 | Sharp |
| 5,693,703 | A | 12/1997 | Hart |
| 5,816,426 | A | 10/1998 | Sharp |
| 6,010,759 | A | 1/2000 | Yamada et al. |
| 6,083,580 | A | 7/2000 | Finestone et al. |
| 6,119,887 | A | 9/2000 | Palazzo |
| 6,221,978 | B1 | 4/2001 | Li et al. |
| 6,280,825 | B1 | 8/2001 | Olvey |
| 2001/0040166 | A1 | 11/2001 | Pietrantoni |

FOREIGN PATENT DOCUMENTS

AU 200053769 B2 6/2001

*Primary Examiner*—Michael C Miggins
(74) *Attorney, Agent, or Firm*—The Webb Law Firm

(57) ABSTRACT

The present invention relates to an underground reservoir for storing liquid products comprising an inner or main reservoir made from a material having known strength characteristics, such as a carbon steel typically used in the industry, and an outer or secondary reservoir comprising a coating, said coating comprising an iinner layer made from an impervious paper and an outer polyurethane-based layer. The present invention also relates to a process for manufacturing said reservoir.

5 Claims, 1 Drawing Sheet

DET· A

DET·A

UNDERGROUND RESERVOIR FOR STORING LIQUID PRODUCTS AND A PROCESS FOR MANUFACTURING AN UNDERGROUND RESERVOIR

BACKGROUND OF THE INVENTION

1. Field of the Invention

The present invention is generally directed to storage devices and, more specifically, to a tank or reservoir particularly designed for storing liquid products below the ground surface which is provided with an outer anticorrosion protective cover for efficiently controlling and monitoring an eventual leakage of the stored liquid. Under another aspect, the present invention is directed to a process for the manufacture of such underground reservoir having an outer anticorrosion protective layer.

2. Description of the Prior Art

A problem with tanks or reservoirs used for storing liquid products at a level below the ground surface, such as those used in fuel sale stations, is that they are frequently structurally deteriorated in view of the aggressive environment in which the same are used.

Indeed, the relatively high corrosion degree of the environment surrounding the tank attacks the material from which the reservoir is manufactured and tends to speed up the corrosion thereof, resulting in a general degradation of its structure which may lead to the occurrence of leaks.

An underground reservoir structurally corroded, besides allowing the leakage of the product stored inside same and, as a consequence, the inadmissible contamination of the surrounding environment, thus increasing the well known risks of pollution, can allow the water to infiltrate into same, what can hamper the quality of the product being commercialized.

Since the costs related to the replacement of such an underground reservoir for storing liquid products can be prohibitively high, without mentioning the problems resulting from the required partial interruption of the traffic along the surface roads close to the place where the same is being installed, a regular replacement of such reservoirs is unfeasible.

A solution which has previously been attempted to solve the foregoing problem was the installation of continuous cathodic protection anodes, such as cable, tape and tubular anodes, buried close to the underground metallic structures such as pipes or storage tanks for protecting same against corrosion.

The anodes provide protection for the reservoir by increasing the electric potential of the ground surrounding same through the application of a direct current to the anode and the ground at a potential enough to keep the reservoir under a negative voltage with relation to the anode and, thus, to protect the metallic surface of the reservoir against any attack.

Typically, the anode is encapsulated in a carbon material such as powdered coke particles to increase the flow of the input current. The anodes are flexible and deemed to be "continuous" in view of the fact that they are elongated and tubular in shape, and can be laid along the reservoir.

This solution, however, is too much expensive and does not fully eliminate the problem of corrosion caused by chemicals on the outer metallic surface of the underground reservoir being used as a supplementary protection means against corrosion in grounds having a high potential.

Another solution previously proposed to address the problem of the attack against the inner and outer walls of the reservoirs was the manufacture of coated or jacketed tanks or reservoirs, that is, having an inner or primary compartment for storing the liquid product and an outer or secondary compartment having slightly larger inner dimensions than those of the inner reservoir, the purpose of which is to function as a protection shield for the inner reservoir.

Typically, in accordance with the constructive dispositions known in the state of the art, such coated or jacketed reservoirs are comprised of tanks having a double steel-steel wall comprising an inner reservoir made from carbon steel in the interior of which the liquid product is stored, and an outer reservoir which is also made from carbon steel and serves as a protection against the corrosion of the main reservoir by agents from the ground and also as a containment barrier in the event of a leakage. There is a minimum gap (interstice) between the two tanks within which a sensor for detecting the presence of liquids is installed on its lowermost point, in order to monitor any leakage that may eventually take place.

Another solution mostly used in view of its lower cost than that of the double steel walls tank is the use of a coated or jacketed reservoir in which the outer or secondary tank is made from fiberglass.

However, such coated or jacketed reservoirs in accordance with the known state of the art present several technical and/or functional disadvantages, among which the following ones can be cited:

The jacketed reservoirs provided with double steel walls are too heavy, thus making the installation of same difficult and expensive due to the need of using larger capacity lifting devices (cranes).

Another problem of such jacketed reservoirs provided with double steel walls is that the process for manufacturing same is laborious and the time for producing same is too long.

The drawback of such coated or jacketed reservoirs provided with double walls made from steel and fiberglass is the fact that the production process involving fiberglass is unhealthy and dangerous because of the toxic and explosive/flammable nature of the materials used in this process, such as acetone, catalysts and aromatic compounds, and thus the whole industrial process should be dealt with carefully, from the storage of raw materials to its application, what should be made in a place provided with an exhaustion and fire-fighting system.

SUMMARY OF THE INVENTION

Therefore, there is a need in the art for an underground reservoir for storing a liquid product which provides a solution for the problems discussed above related to the coated or jacketed reservoirs known in the state of the art, which is an object of the present invention.

Another object of the present invention is to provide such coated underground reservoir for storing liquid products which additionally provides a highly impact resistant coating.

An additional object of the present invention is to provide such coated underground reservoir for storing liquid products the coating of which can easily be repaired when damages are caused to same during the handling, transportation or installation of the reservoir.

Another additional object of the present invention is to provide such coated underground reservoir for storing liquid products the coating material of which presents an excellent electric insulation, a characteristic that is important for the reservoirs designed for storing flammable products.

Another additional object of the present invention is to provide such coated underground reservoir for storing liquid products whose process of industrialization is extremely clean and non-toxic, for it does not involve toxic solvents or agents.

Still another additional object of the present invention is to provide such coated underground reservoir for storing liquid products whose process of industrialization is simpler and faster, has less operating steps, and uses less raw materials.

Another object of the present invention is to provide such coated underground reservoir for storing liquid products whose process of industrialization uses a small industrial area, without the need of systems for preventing fire and/or for exhausting the gases evolved from toxic agents.

Still another additional object of the present invention is to provide such coated underground reservoir for storing liquid products whose process of industrialization requires a minimum supply of raw materials.

In accordance with the present invention, such objects are accomplished through the provision of an underground reservoir for storing liquid products comprising an inner or main reservoir made from a material having known strength characteristics, such as a carbon steel typically used in the industry, and an outer or secondary reservoir comprising a coating layer, said coating layer being formed by an inner layer made from an impervious paper and an outer layer made of polyurethane.

In accordance with an aspect, the present invention is directed to a process for manufacturing an underground reservoir comprised of the steps of providing an inner or main reservoir made from a material having known strength characteristics, such as carbon steel typically used in the industry, blasting portions of the outer surface of said main reservoir to allow for the adherence of the outer coating, covering same with a first coating layer comprising an impervious paper, and applying an outer layer to the pure polyurethane base, without adding any solvent, having a minimum thickness desired.

Other objects and characteristics of the present invention will be apparent from the following detailed description of the preferred embodiment, taken in conjunction with the accompanying drawings.

BRIEF DESCRIPTION OF THE DRAWINGS

The present invention will be additionally described here as follows, as a non-limiting example, with reference to its presently preferred embodiment which is illustrated in the accompanying drawings, in which.

DETAILED DESCRIPTION OF THE PREFERRED EMBODIMENT

A specific embodiment presently preferred of the present invention is illustrated as an example in the accompanying drawings and will be described in details hereinafter. However, it should be understood that though the present invention is susceptible to several modifications and alterations in the form and dimensions, the purpose of the present specification is not to limit same to the particular forms and/or dimensions described herein but, instead, to cover all the modifications and alternative embodiments that are within the spirit and scope of the invention, as defined by the accompanying claims.

Figure 1:
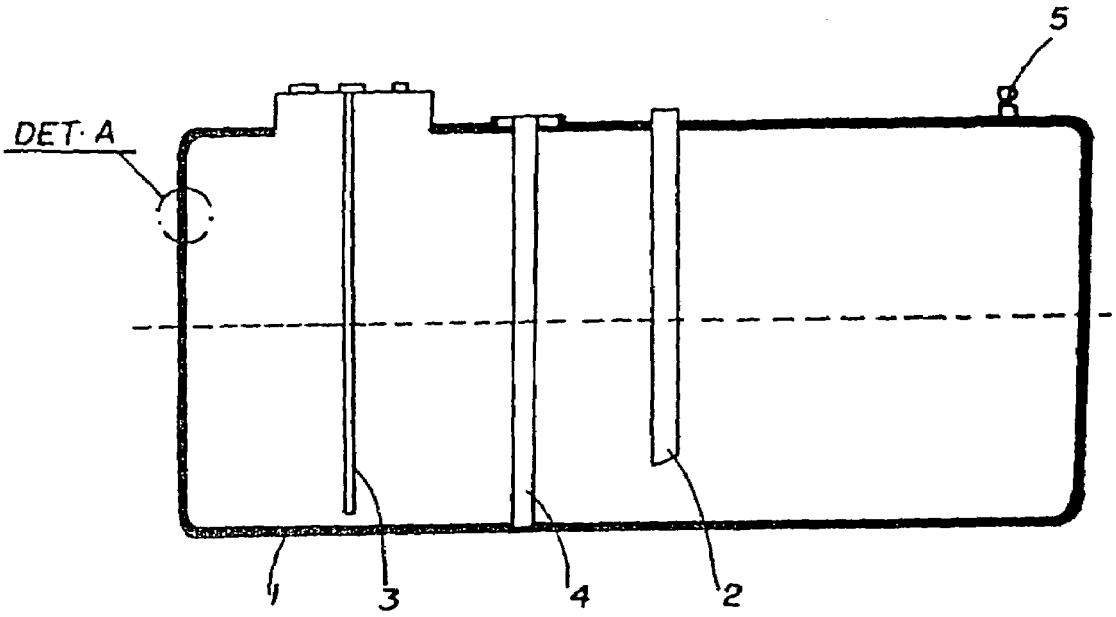
FIG. 1 is a side sectional cut view of an underground reservoir for storing liquid products in accordance with the present invention; e

With reference now more particularly to the accompanying Figures, in which the same numerals have been used to indicate the same elements in the different views and, with particular reference to FIG. 1, the coated reservoir in accordance with the present invention is illustrated as comprising a primary or inner reservoir 1 made from a material having a known strength characteristic, such as carbon steel typically used in the industry.

The reservoir 1 is provided with a pipe 2 for feeding the liquid product to be stored, a pipe 3 for sucking the product stored for distribution, and a well 4 for the buoy (not shown) of the sensor for detecting the presence of liquid, as well as a check point 5 the purpose of which is to allow for the verification of the integrity of the outer reservoir after it is assembled and even during and after the jacketed reservoir is installed to the place it will be used.

Figure 2:
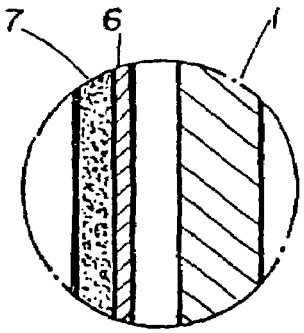
FIG. 2 is an expanded side section view of the detail "A" of FIG. 1.

As can be better seen from FIG. 2, the primary or inner reservoir 1 is coated with a two-compound material comprising an inner layer 6 made from impervious paper, preferably based on latex, and an outer layer 7 based on pure polyurethane, without the addition of any solvent, which it is applied and cured on the inner paper layer 6.

The process for manufacturing the tank coated in accordance with the present invention is quite simple and will be briefly described hereinafter.

After the main reservoir is constructed in accordance with the traditionally used manufacturing methods in the industries of the sector and, according to the applicable regulations, the same is subjected to a blasting process in specific areas of its outer surface, the purpose of which is to assure the adherence of polyurethane to such areas.

In this step, depending on the type of the sensor for detecting the presence of liquid to be used, the well 4 for the buoy of the sensor should be formed, or in the case of an electronic sensor, the sensor should be installed.

Next, the outer surface area of the main reservoir is covered with impervious latex-based paper to form the inner coating layer 6.

After being coated with paper, the tank is conveyed to a painting station, wherein the outer polyurethane layer 7 is applied through an airless process, until a layer of at least 2.5 mm of thickness is obtained.

After the effective cure of the coating material, tests should be carried out to guarantee the quality and tightness of the application (devices for measuring the thickness of the coating and pneumatically testing in the interstice).

The two-compound coating material resulting from the application of the inner paper layer and the outer polyurethane layer is particularly suitable for the intended purpose, because the paper layer provides the polyurethane with a tensile strength that this chemical usually does not show, whereas the polyurethane layer provides the paper with a high strength to impacts that could rupture or cut said layer.

Additionally, besides being impervious, said two-compound material of the secondary reservoir is an electrically insulating non-metallic material, thus preventing the possibility of forming a galvanic couple that could speed up the corrosion of the inner reservoir.

The underground reservoir for storing liquid products in accordance with the present invention effectively solves the problems of the coated reservoirs known in the state of the art, thus additionally providing a coating with a high strength to impact, which can easily be repaired when damages are caused to same during the handling, transportation or installation from the reservoir and which presents excellent electric insulation characteristics, which is important to reservoirs designed for storing flammable products.

Also, the industrialization process of the underground reservoir for storing liquid products in accordance with the present invention is extremely clean and non-toxic, for it does not involve the use of toxic solvents or agents, is simpler and faster, has less operating steps, and uses less raw materials.

Additionally, the underground reservoir in accordance with the present invention only needs a small industrial area, without the need of special arrangements against fire and/or toxic agents, with a minimum supply of raw materials.

The best form of realization currently contemplated for the accomplishment of the present invention having been described and illustrated, several modifications and variations in its form of realization will be readily apparent to those skilled in the art. Therefore, it will be understood that the present invention is not limited to the practical aspects of the presently preferred embodiment illustrated and described herein, and that all such modifications and variations should be considered as being encompassed within the spirit and scope of the invention, such as defined in the accompanying claims.

The invention claimed is:

1. An underground reservoir for storing liquid products, comprising:

a main tank made from a carbon steel material; and a two-component coating material overlying an outer surface of the main tank, the coating material consisting of: (1) an impervious paper material in direct contact with the main tank and (2) a polyurethane paint material, which is made without the addition of any solvents, applied to an outer surface of the impervious paper material, wherein the formed two-component coating material has a strength suitable for alleviating impacts that could rupture the two-component coating material.

2. The underground reservoir of claim 1, where the polyurethane paint coating is made of pure polyurethane.

3. A method for manufacturing an underground reservoir, consisting of:

providing a main tank made from a carbon steel material;

directly contacting an outer surface of the main tank with an impervious paper material; and painting a polyurethane material on an outer surface of the impervious paper material;

wherein the formed two-component coating material has a strength suitable for alleviating impacts that could rupture the two-component coating material.

4. The method of claim 3, further comprising jet-blasting at least a portion of the outer surface of the main tank to enhance the adhesion of the impervious latex-based paper material.

5. The method of claim 3, wherein the polyurethane material is made of pure polyurethane.

* * * * *

UNITED STATES PATENT AND TRADEMARK OFFICE

CERTIFICATE OF CORRECTION

PATENT NO. : 7,556,847 B2
APPLICATION NO. : 11/606851
DATED : July 7, 2009
INVENTOR(S) : Seneor It is certified that error appears in the above-identified patent and that said Letters Patent is hereby corrected as shown below:

Column 6, Line 21, Claim 4, delete "latex-based"

Signed and Sealed this

Thirteenth Day of October, 2009

David J. Kappos

David J. Kappos
*Director of the United States Patent and Trademark Office*